US007958931B2

(12) United States Patent
Seidel et al.

(10) Patent No.: US 7,958,931 B2
(45) Date of Patent: Jun. 14, 2011

(54) METHOD OF CASTING ROLLING WITH INCREASED CASTING SPEED AND SUBSEQUENT HOT ROLLING OF RELATIVELY THIN METAL STRANDS, PARTICULARLY STEEL MATERIAL STRANDS AND CASTING ROLLING APPARATUS

(75) Inventors: Jürgen Seidel, Kreuztal (DE); Jürgen Klöckner, Nepthen (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 11/794,431

(22) PCT Filed: Dec. 14, 2006

(86) PCT No.: PCT/EP2006/012036

§ 371 (c)(1),
(2), (4) Date: Jun. 28, 2007

(87) PCT Pub. No.: WO2007/079898

PCT Pub. Date: Jul. 19, 2007

(65) Prior Publication Data

US 2008/0093049 A1 Apr. 24, 2008

(30) Foreign Application Priority Data

Jan. 10, 2006 (DE) ..... 10 2006 001 195

(51) Int. Cl.
*B22D 11/06* (2006.01)

(52) U.S. Cl. ..... 164/476; 164/480

(58) Field of Classification Search ..... 164/480, 164/428, 476, 417

See application file for complete search history.

(56) References Cited

U.S. PATENT DOCUMENTS

| | | | | |
|---|---|---|---|---|
| 5,553,469 | A * | 9/1996 | Seidel | 72/13.4 |
| 6,046,464 | A | 4/2000 | Schetzina | |
| 2003/0015708 | A1 | 1/2003 | Parikh et al. | |
| 2003/0085409 | A1 | 5/2003 | Shen et al. | |
| 2004/0055398 | A1 * | 3/2004 | Weyer et al. | 73/862.49 |
| 2004/0069034 | A1 * | 4/2004 | Seidel | 72/39 |
| 2004/0207313 | A1 | 10/2004 | Omoto et al. | |
| 2005/0173692 | A1 | 8/2005 | Park et al. | |
| 2005/0173728 | A1 | 8/2005 | Saxler | |

(Continued)

FOREIGN PATENT DOCUMENTS

DE 195 18 144 11/1995

(Continued)

OTHER PUBLICATIONS

Notice Requesting Submission of Opinion re related Korean application No. 10-2004-7001033, dated: Mar. 9, 2009.

(Continued)

*Primary Examiner* — Kuang Lin

(74) *Attorney, Agent, or Firm* — Lucas & Mercanti, LLP; Klaus P. Stoffel

(57) ABSTRACT

A method for continuous casting and rolling at increased casting speed followed by hot rolling of relatively thin metal strand, especially steel strand (1), where presetting of target temperatures (6) of the hot strip (2) reduces temperature losses in the hot strip (2) by increasing the temperatures of the work rolls (4) at a predetermined rate of increase, starting from a low initial temperature (5), and by adjusting the strip temperature (15) to a target rolling temperature (6) of the hot strip (2) and/or by automatically controlling or regulating the intensity of the roll cooling (18).

15 Claims, 4 Drawing Sheets

U.S. PATENT DOCUMENTS

| | | | | |
|---|---|---|---|---|
| 2006/0010679 | A1 * | 1/2006 | Hohenbichler et al. | ..... 29/527.7 |
| 2007/0090383 | A1 | 4/2007 | Ota et al. | |
| 2008/0036364 | A1 | 2/2008 | Li et al. | |

FOREIGN PATENT DOCUMENTS

| | | | |
|---|---|---|---|
| DE | 19830034 | | 12/1999 |
| EP | 0 415 987 | | 12/1992 |
| EP | 0936682 | | 8/1999 |
| EP | 1349202 | A | 10/2003 |
| EP | 1510265 | | 2/2005 |
| JP | 60 238 012 | | 11/1985 |
| JP | 01 130 802 | | 5/1989 |
| JP | 10249426 | | 9/1998 |
| WO | WO9856043 | | 12/1998 |
| WO | WO 0211212 | A | 2/2002 |
| WO | WO03080763 | | 10/2003 |
| WO | WO 2004/007118 | * | 1/2004 |
| WO | 2004/026497 | | 4/2004 |
| WO | WO 2007005844 | A | 11/2007 |

OTHER PUBLICATIONS

Zhang et al. "Comparison of GaN P-I-N and Schottky Rectifier Performance", IEEE Transactions on Electron Devices, vol. 48, No. 3, Mar. 2001, pp. 407-411.

Sakai et al., "Experimental Investigation of Dependence of Electrical Characteristics on Device Parameters in Trench MOS Barrier Schottky Diodes", 1998, International Symposium on Power Semiconductor Devices & ICs, Kyoto, pp. 293-296.

European Search Report re related European Application No. 08253301.9-2222.2-24-09.

European Search Report re related EP Appl. 08160129.6.2222, Dated: Dec. 15, 2008.

Asbeck et al."Enhancement of Base Conductivity Via the Piezoelectric Effect in A1GaN/GaN HBTs", Solid State Electronics, Elsevier Science Pub. Barking GB, vol. 44, No. 2, Feb. 1, 2000 pp. 211-219, XP004186190.

Johnson et al."New UV Light Emitter Based on A1GaN Heterostructures with Graded Electron and Hole Injectors", Materials Research Society Symposium—Proceedings 2002 Materials Research Society US, vol. 743, 2002, pp. 481-486.

Simon et al. "Polarization-Induced 3-Dimensional Electron Slabs in Graded AlGaN Layers", Materials Research Society Symposium Proceedings 2006 Materials Research Society US, vol. 892, Nov. 28, 2005, pp. 417-422.

Official Notice of Final Decision of Rejection re related Japanese Patent Appl. No. 2003-529535, Dated: Jan. 6, 2009.

European Communication from related European Appl. 02 798 906. 0-1235, Dated Feb. 6, 2009.

European Search Report from related European Application No. 07254498.4, received on Feb. 11, 2010.

Manufacturing Engineering and Materials Processing/10, Hot Rolling of Steel, William L. Roberts, pG. 605-608, 1983.

* cited by examiner

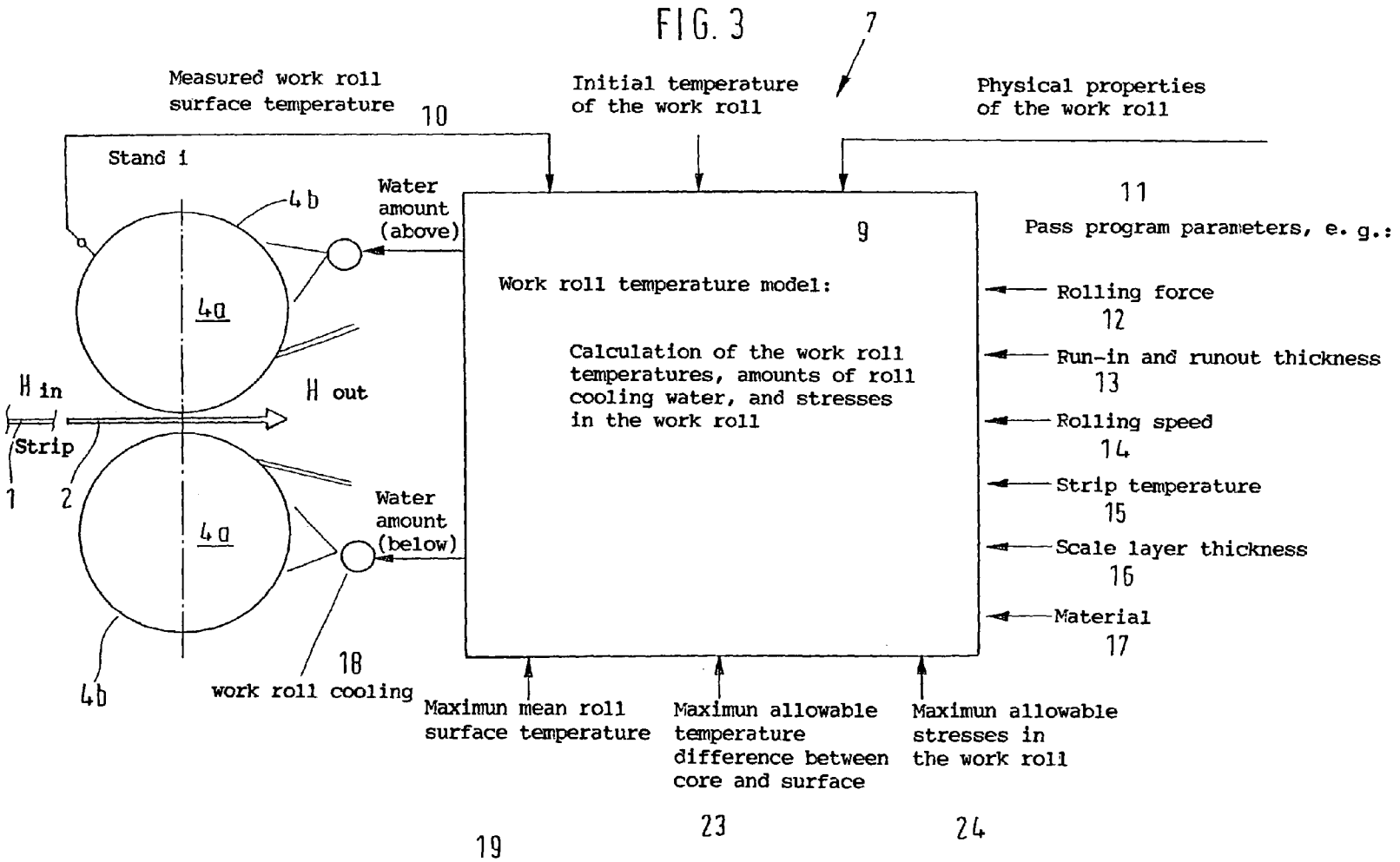
FIG. 3
7
Physical properties of the work roll
Initial temperature of the work roll
Measured work roll surface temperature
10
Pass program parameters, e. g.:
11
Rolling force
12
Run-in and runout thickness
13
Rolling speed
14
Strip temperature
15
Scale layer thickness
16
Material
17
9
Work roll temperature model:
Calculation of the work roll temperatures, amounts of roll cooling water, and stresses in the work roll
Maximun allowable stresses in the work roll
24
Maximun allowable temperature difference between core and surface
23
Maximun mean roll surface temperature
19
Water amount (above)
Water amount (below)
18
work roll cooling
Stand 1
4b
4a
4a
4b
H out
H in
Strip
1
2

3n
13
H=1mm
F7
F6
F5
F4
F3
F2
F1
3a
4
4
8
8a
25
H=70mm
3
15
Strip temperature
1180°C
5
Rolls with elevated work roll temperature (1400°C) on F1-F7
19a
6
910°C
805°C
Rolls with normal work roll temperature
Position

METHOD OF CASTING ROLLING WITH INCREASED CASTING SPEED AND SUBSEQUENT HOT ROLLING OF RELATIVELY THIN METAL STRANDS, PARTICULARLY STEEL MATERIAL STRANDS AND CASTING ROLLING APPARATUS

BACKGROUND OF THE INVENTION

The invention concerns a method for continuous casting and rolling at increased casting speed followed by hot rolling of relatively thin metal strands, especially steel strands, into thin, hot-rolled strip in a multiple-stand hot-strip finishing train with automatic control of the temperatures of the work rolls, and a continuous casting and rolling installation for carrying out this method.

Rolling at (high) casting speeds, i.e., the coupling of a continuous casting plant and a hot-strip finishing train, leads to relatively low conveying speeds within the hot-strip finishing train downstream of the continuous casting plant. Despite high initial temperatures (e.g., about 1,250° C.), a required final rolling temperature of more than 850° C. cannot be maintained under ordinary conditions due to temperature losses to the environment and to the work rolls. Large amounts of energy are transferred to the work rolls.

The aforesaid ordinary conditions exist, for example, in a continuous casting plant that allows high casting speeds and provides high initial temperatures for the hot-strip finishing train.

It is also well known (DE 198 30 034 A1) that the temperature of the work rolls can be automatically controlled with cross-field inductors and the use of a computer model that incorporates strip width, material values, draft per pass, rolling speed, rolling temperatures, and roll cooling. However, the result is used for automatic control of the temperatures in the peripheral regions to be adjusted in the work rolls and the rolled strip.

It is also known (EP 0 415 987 B2) that so-called thin slabs (cast strands about 50 mm thick) can be inductively heated again in individual rolling steps before and within the finishing train, which requires a large amount of electric power.

It has also already been proposed that the diameters of the work rolls be reduced to reduce the heat flux into the rolls.

SUMMARY OF THE INVENTION

The objective of the invention is to reduce temperature loss in the hot strip within the hot-strip finishing train during continuous casting and rolling, so that the target rolling temperature at the end of the rolling process can be adjusted more exactly and especially higher.

In accordance with the invention, this objective is achieved by a method for continuous casting and rolling, which is characterized by the fact that at casting speeds of about 4 m/minute to 12 m/minute and taking into account relatively thin thicknesses of the cast strand, the rolling speeds are adjusted, where the temperatures of the work rolls are increased at a predetermined rate of increase, starting from a low initial temperature, and the strip temperature within the hot-strip finishing train is adjusted to a target rolling temperature of the hot strip and/or by automatically controlling or regulating the intensity of the roll cooling. In this way, the heat loss is minimized during continuous rolling (and coupling of the casting and rolling processes), and the rolling can be achieved with high work roll temperatures for all of the rolling stands of a hot-strip finishing train. The heat for heating the work rolls can be derived from the process heat. In this regard, the roll cooling is adjusted as a function of external boundary conditions in such a way that the work roll slowly reaches the target temperature (of about 400° C.) at the predetermined rate of increase and is near the tempering temperature of the roll material. Coupling of the casting and rolling process occurs, for example, at casting speeds of 4-12 m/minute and customary casting thicknesses of 20-90 mm and at rolling speeds of about 0.3-18 m/second.

In a modification of the method, for given pass program data, a target temperature is adjusted which is below the tempering temperature of the roll material of the work rolls.

In a modification of the method, a maximum roll temperature is adjusted by applying a predetermined amount of cooling water to the work rolls, and the strip speed is adjusted. These measures make it possible to achieve the predetermined target temperature of the strip.

It is advantageous to adjust the temperature difference between the core of the work roll and the surface of the work roll in such a way that acceptable stresses in the work roll are not exceeded.

In addition, stress monitoring can be carried out within the work roll both in the radial and in the axial direction on the basis of a calculated temperature and stress field.

In accordance with other features of the invention, the stress monitoring is controlled by an online computer model.

Furthermore, before being used, the work roll can be preheated to an initial temperature. At a preheated temperature of 200° C., the steady state is reached faster and/or the stress level in the rolls is lower.

In accordance with other features of the invention, the work rolls are operated with strip temperatures elevated relative to the intended temperature level. Strip heat losses can be systematically compensated in this way.

A practical method is to preheat the work roll in an induction field with rotation. This results in locally limited and systematic heating, depending on the mass distribution of the work roll.

In an improvement of the process sequence, the inductive heating of the surface of the work roll is undertaken on the run-in side of a rolling stand. This increases the work roll contact temperature in the roll gap and minimizes the heat loss of the strip inside the roll gap. The desired effect is already obtained before a high core temperature is reached.

It is further proposed that the inductive heating of a work roll varies over the barrel length.

In accordance with other features for improving the process sequence, the work roll is preheated in the induction field inside the hot-strip finishing train or before the installation next to the hot-strip finishing train.

In a measure that requires special mention, in addition to the intensity of the roll cooling and/or the intensity of the inductive heating, the structure of the rolling program is used as a controlled variable during the start-up process.

The boundary conditions for reducing the loss of strip temperature are further improved by operating the descaling unit with a minimal amount of water, especially by operating only a single row of descaling sprayers.

Another approach to adjusting the cooling effect consists in automatically controlling the cooling intensity of the work roll cooling by finely metered coolant and/or spray.

In addition, it may be provided that only some of the rolling stands of the hot-strip finishing train are operated with elevated temperatures of their work rolls.

Furthermore, the effect of a higher roll temperature and the effect of expansion of the work rolls by work roll heat on the shape of the strip near the strip edge can be compensated by mechanical and/or thermal profile correcting elements.

The continuous casting and rolling installation requires a previously known continuous casting installation and a hot-strip finishing train, a heating device, and a cooling device for the work rolls assigned to each rolling stand.

The development and refinement of the hot-strip finishing train consist in the fact that the length of the work rolls is adjusted to a temperature increase and that the work roll bearings are cooled and are connected to a circulating oil lubrication system or are lubricated by special grease. This allows the temperature increases (rates of increase) to be safely absorbed by the bearings.

Another measure for saving heating energy and increasing the service life of the work rolls consists in grinding the work rolls in a hot state.

In this connection, it is also advantageous for the work rolls to be made of heat-resistant and wear-resistant materials.

The higher temperatures of the work rolls can also be taken into account by providing HIP (hot isostatic pressing) rolls for the rolling stands of the hot-strip finishing train.

In accordance with other features, an online computer model incorporates a work roll temperature model based on the measured work roll surface temperatures, the initial temperature of the work roll, and the physical properties of the work roll.

As supplementary features, the work roll temperature model also takes into account the maximum mean roll surface temperature, the maximum allowable temperature difference between the work roll core and the work roll surface, and the maximum allowable stress in the work roll.

Another measure for counteracting high temperature loss of the hot strip consists in installing roller table covers between the rolling stands.

Improved suppression of scaling or oxide coating control of the hot strip and work roll is achieved by providing inert gas supply lines between the front rolling stands under the roller table covers.

In another embodiment of the invention, the pass program parameters include at least the rolling force, the run-in and runout thickness, the rolling speed, the strip temperature, the thickness of the layer of scale, and the strip material.

To this end, the thickness decrease in the pass program is shifted to the rear region of the hot-strip finishing train.

Other measures that are useful for the process result from the fact that a minimum runout thickness is limited to a fixed value.

The following data for a typical process and a typical continuous strip finishing train are provided as an example: a hot-strip finishing train with about seven rolling stands for a cast strand thickness of H=50-90 mm and a minimum runout thickness of 0.6 to 1.2 mm.

Specific embodiments of the method are illustrated in the figures and explained in detail below.

BRIEF DESCRIPTION OF THE DRAWING:

FIG. 3 is a block diagram of the systematic structure of the work roll temperature model.

DETAILED DESCRIPTION OF THE INVENTION:

In a conventional hot-strip finishing train 3 for metal strip 1, especially steel strip, the strip is rolled in a discontinuous thin-strip production operation, for example, for about 180 seconds, followed by a rolling pause of about 20 seconds. During the rolling phase, a mean work roll surface temperature 19 of about 120° C. develops, and during the rolling pause the surface is cooled back down practically to the temperature of the cooling water. After a large number of hot-rolled strips 2, roll temperatures of about 90° C. can be measured at the end of the rolling program.

When the continuous casting plant and the hot-strip finishing train 3 are directly connected, a strip temperature loss develops during the continuous rolling in the hot-strip finishing train 3 and must be minimized by suitable measures. For this reasons, rolling with higher work roll temperatures for all or some of the rolling stands 3*a* . . . 3*n* is proposed.

Figure 1:
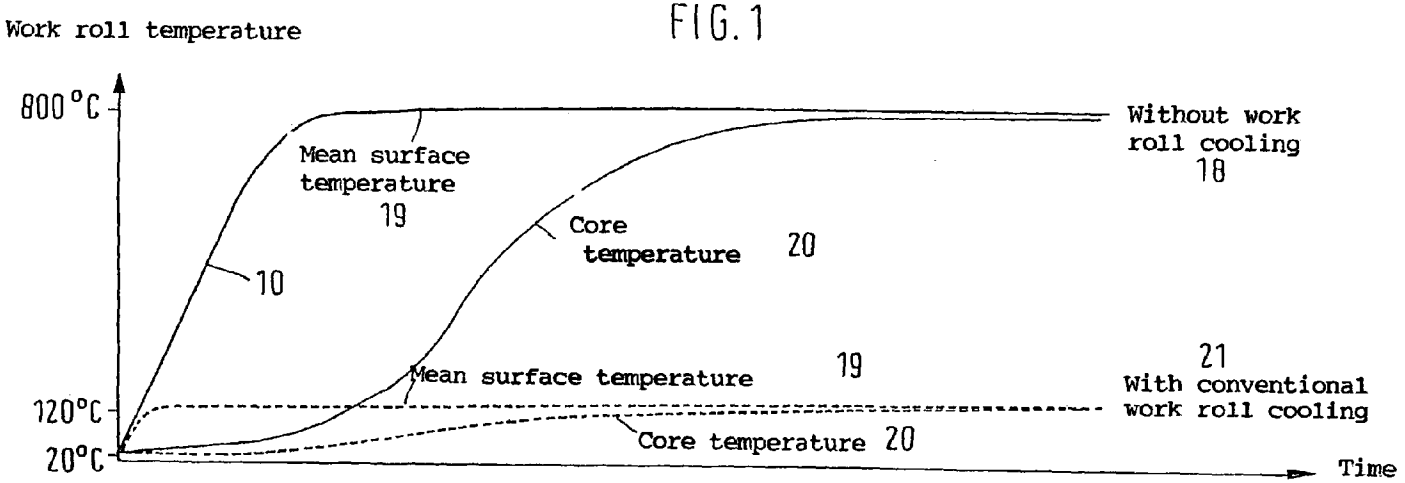
FIG. 1 is a graph of the work roll temperature as a function of time, which shows curves without work roll cooling and with conventional work roll cooling.

The graph in FIG. 1 (work roll temperature over time) chiefly shows the change in the mean surface temperature 19 and the core temperature 20 of the work rolls 4 without work roll cooling 18. The curves in the lower part of the graph show how the core temperature 20 (of, e.g., 20° C.) approaches the mean surface temperature 19 (of, e.g., 120° C.) with the conventional work roll cooling 21 of the type customarily used in rolling mills. It is apparent that, with increasing operating time, the core temperature 20 approaches the mean surface temperature 19 under otherwise unchanged rolling conditions and then remains approximately equal to it.

Accordingly, the goal is to meter the roll cooling as a function of external boundary conditions in such a way that the work roll 4 reaches the target temperature 6 in FIG. 2 of about 400° C. at a predetermined rate of increase and is below the tempering temperature of the roll material. In this connection, the temperature field within the work roll 4 or the temperature difference between the roll core 4*a* and the roll surface 4*b* must be adjusted in such a way that allowable stresses in the work roll 4 are not exceeded. This procedure applies to the radial as well as the axial direction. The online computer model in FIG. 3 is used for this purpose.

Figure 2:
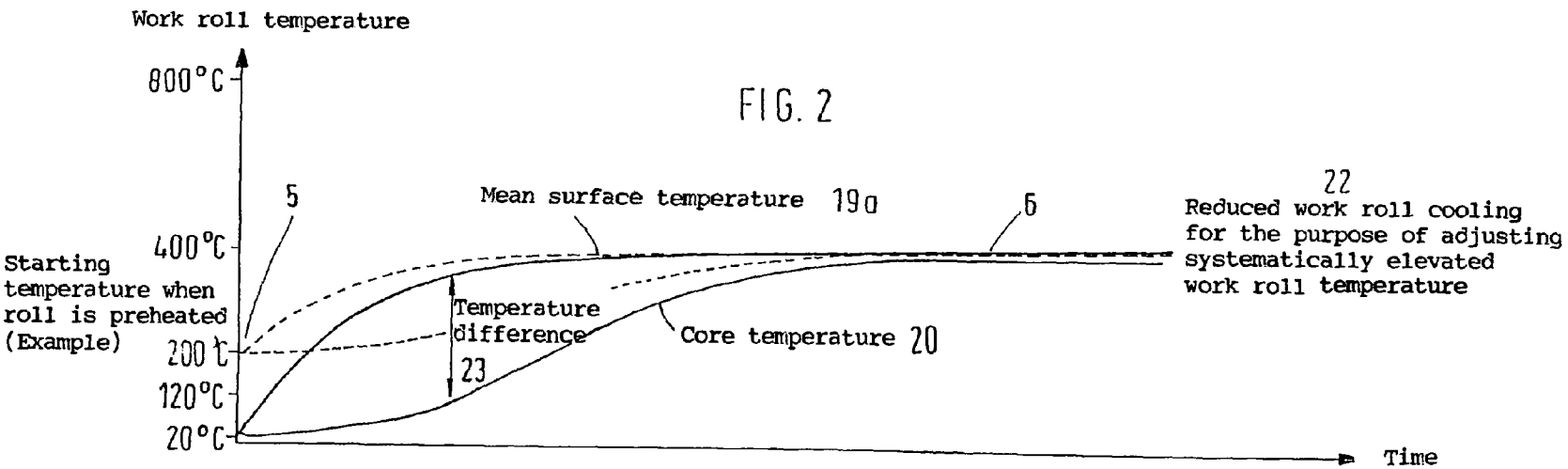
FIG. 2 is the same graph for reduced work roll cooling for the purpose of establishing systematically elevated work roll temperatures.

By contrast, the broken curve in FIG. 2 shows work roll cooling 22 reduced in accordance with the invention at an elevated mean surface temperature 19*a* for the purpose of adjusting systematically elevated work roll temperatures in a preheated work roll 4 to an initial temperature 5 of, for example, 200° C., initially a temperature difference 23 from the core temperature 20. The hotter work roll 4 thus prevents an undesirable reduction of the strip temperature 15 as a result of the mean surface temperature 19*a* of, for example, 400° C.

FIG. 3 shows the basic features of the online computer model 7. In the work roll temperature model 9, the work roll temperatures, the amounts of roll cooling water, and the stresses in the work roll 4 are calculated. At least the following parameters enter into the calculation: a maximum mean surface temperature 19, a maximum allowable temperature difference 23 between the core and the surface, and maximum allowable stress values 24 in the work roll 4.

The following pass program parameters are used: the rolling force 12, the run-in and runout thickness 13, the rolling speed 14, the strip temperature 15, the thickness of the layer of scale 16, and the strip material 17 itself.

Figure 4:
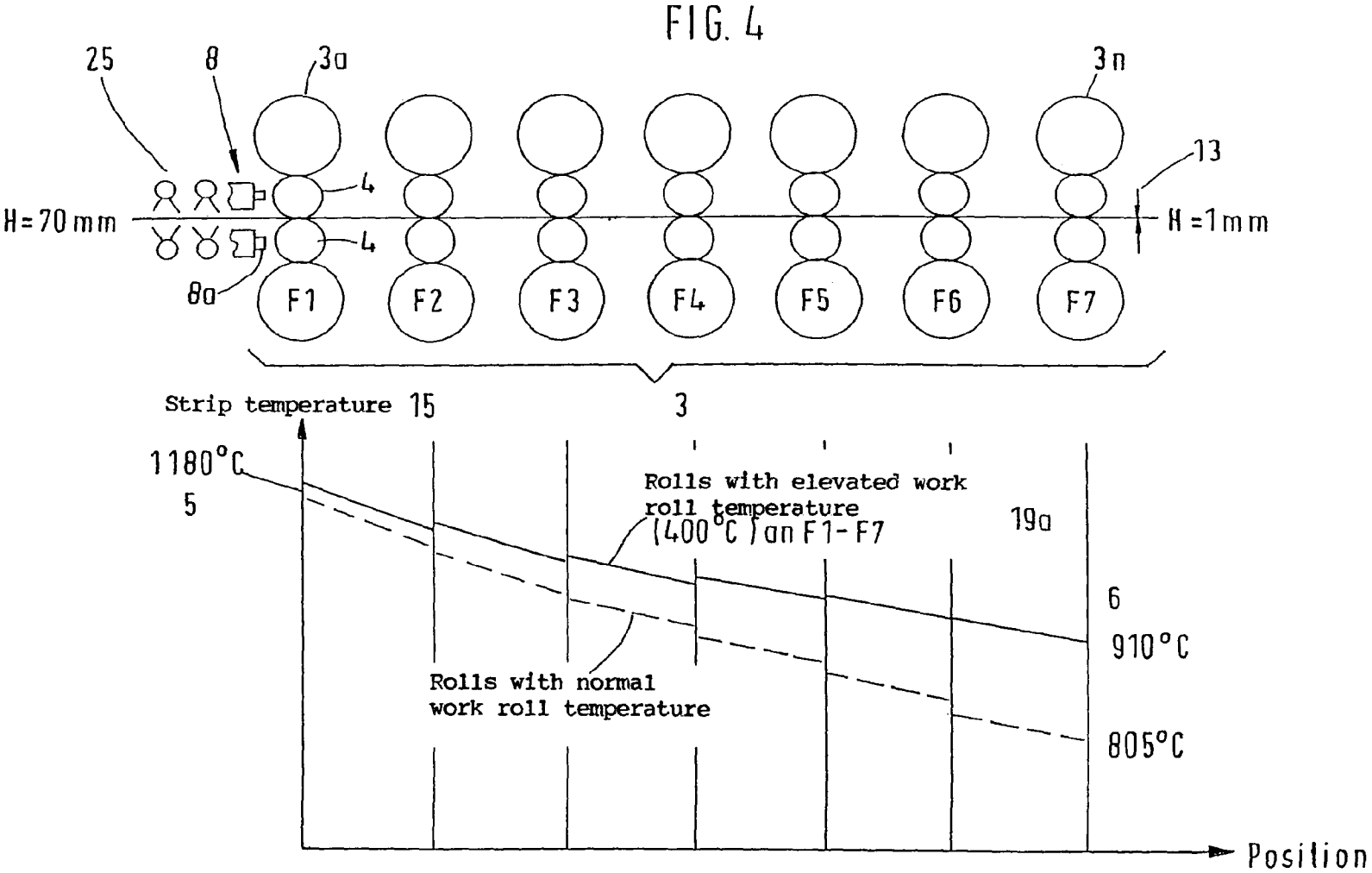
FIG. 4 shows the hot-strip finishing train and the strip temperature curve through the hot-strip finishing train at different work roll temperature levels.

FIG. 4 shows as an example a hot-strip finishing train 3 and the course of the strip temperature 15 for different boundary conditions. A descaling unit 25, which preferably has a single row of descaling sprayers, is located upstream of the finishing train 3. If all of the rolling stands 3*a* . . . 3*n* are operated at an elevated work roll temperature, e.g., at 400° C. in F1 to F7, this has a positive effect on the local strip temperature 15. In the example illustrated here, an initial temperature 5 of 1,180° C. downstream of the descaling unit 25 and a target temperature 6 of 910° C. can then be achieved. When customary work roll temperatures are used, an unacceptably low strip temperature 15 of, for example, 805° C., becomes established, as indicated by the broken curve in FIG. 4.

Provision is made to heat or preheat the work roll 4 in an induction field 8*a*. This device is shown in FIG. 4 only on the run-in side of the rolling stand F1. However, the installation of a heating device for all of the rolling stands 3*a* . . . 3*n* is advantageous and feasible.

The intensity of the inductive heating 8*a* of the work roll 4 can also be variably preset over the length of the roll.

Figure 5:
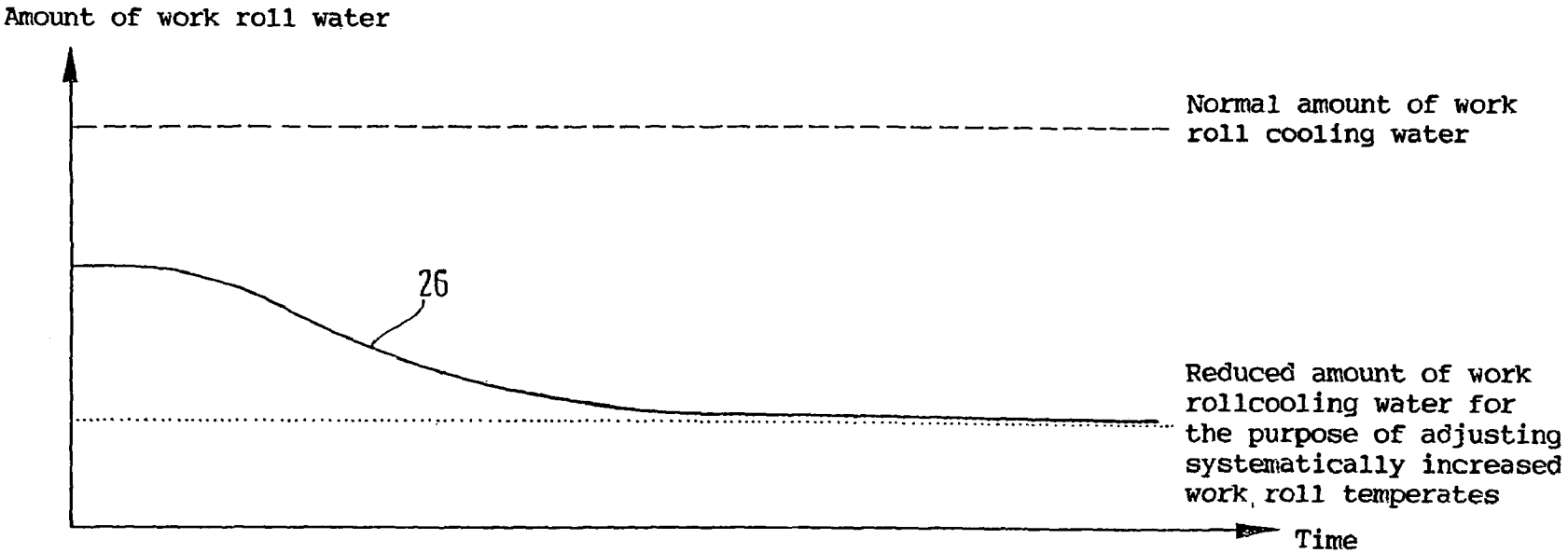
FIG. 5 is a graph of the amount of work roll cooling water as a function of time.

The process or behavior of the amount of work roll cooling water 26 is shown in FIG. 5. Compared to a "normal" amount of cooling water, in this process a smaller amount is usually used at the beginning of the illustrated continuous rolling process, and this smaller initial amount is then further reduced towards a set amount preset by the online computer model 7 as the core temperature 20 of the roll increases.

The method described above for reducing the heat dissipation from the work rolls 4 is not limited to the illustrated application of continuous rolling with relatively long rolling times and low rolling speeds. The method can also be used in conventional single-stand or multiple-stand hot-strip rolling mills.

For temperature-sensitive materials, at relatively high roll temperature the roll contact produces a smaller amount of undercooling of the strip surface. This results in the development of homogeneous properties within the strip, e.g., over the strip thickness.

LIST OF REFERENCE NUMBERS

1 metal strand, especially steel strand
2 thin hot strip
3 hot-strip finishing train
3*a* . . . 3*n* rolling stands
4 work roll
4*a* work roll core
4*b* work roll surface
5 initial temperature
6 target rolling temperature
7 online computer model
8 heating device
8*a* induction field
9 work roll temperature model
10 work roll surface temperature
11 pass program parameters
12 rolling force
13 run-in and runout thickness
14 rolling speed
15 strip temperature
16 scale layer thickness
17 strip material
18 work roll cooling
19 mean surface temperature
19*a* elevated mean surface temperature
20 core temperature
21 conventional work roll cooling
22 reduced work roll cooling
23 initial temperature difference
24 maximum allowable stress values in the work roll
25 descaling unit
26 curve of the amount of work roll cooling water

The invention claimed is:

1. A method for continuous casting and rolling at increased casting speed followed by hot rolling of relatively thin metal strands (1), at relatively low strip speed, into thin, hot-rolled strip (2) in a multiple-stand hot-strip finishing train (3) with automatic control of the temperatures of the work rolls (4), comprising the steps of: at casting speeds of about 4 m/minute to 12 m/minute and taking into account the relatively thin thicknesses of the cast strand, adjusting the rolling speeds; increasing the temperatures of the work rolls of the finishing train (4) at a predetermined rate of increase, starting from a low initial temperature (5) by preheating of work rolls with a induction heating device and adjusting rolling speed; and adjusting the strip temperature (15) within the hot-strip finishing train (3) to a target rolling temperature (6) of the hot strip (2) by automatically controlling or regulating the intensity of the roll cooling (18) of the work rolls in the finishing train.

2. A method in accordance with claim 1, wherein, for given pass program data, a target temperature (6) is adjusted which is below the tempering temperature of the roll material of the work rolls (4).

3. A method in accordance with claim 1, wherein a maximum roll temperature is adjusted by applying a predetermined amount of cooling water (26) to the work rolls (4), and the strip speed is adjusted, in order to achieve the predetermined-target temperature (6) of the strip.

4. A method in accordance with claim 1, wherein the temperature difference between the work roll core (4*a*) and the work roll surface (4*b*) is adjusted in such a way that acceptable stresses in the work roll (4) are not exceeded.

5. A method in accordance with claim 4, wherein stress monitoring is carried out within the work roll both in the radial and in the axial direction on the basis of a calculated temperature and stress field.

6. A method in accordance with claim 4, wherein the stress monitoring is controlled by an online computer model (7).

7. A method in accordance with claim 1, wherein the work rolls (4) are operated with strip temperatures elevated relative to the intended temperature level.

8. A method in accordance with claim 5, wherein the work roll (4) is rotated and preheated in an induction field (8*a*).

9. A method in accordance with claim 8, wherein the inductive heating of the work roll surface (4*b*) is undertaken on the run-in side of a rolling stand (3*a* . . . 3*n*).

10. A method in accordance with claim 8, wherein the inductive heating of a work roll (4) varies over a barrel length of the work roll.

11. A method in accordance with claim 8, wherein the work roll (4) is preheated in the induction field (8*a*) inside the hot-strip finishing train (3) or before the installation next to the hot-strip finishing train (3).

12. A method in accordance with claim 1, wherein, in addition to the intensity of the roll cooling and/or the intensity of the inductive heating, the configuration of the rolling program is used as a controlled variable during the start-up process.

13. A method in accordance with claim 1, wherein the descaling unit (25) is operated with a minimal amount of water by using only a single row of descaling sprayers.

14. A method in accordance with claim 1, wherein the cooling intensity of the work roll cooling (18) is automatically controlled by applying a finely metered coolant and/or spray.

15. A method in accordance with claim 1, wherein only some of the rolling stands (3*a* . . . 3*n*) of the hot-strip finishing train (3) are operated with elevated temperatures of their work rolls (4).

* * * * *